US009597696B2

(12) United States Patent
Mauchle et al.

(10) Patent No.: US 9,597,696 B2
(45) Date of Patent: Mar. 21, 2017

(54) SCREEN INSERT FOR A POWDER CHAMBER OF A POWDER SUPPLYING DEVICE

(75) Inventors: Felix Mauchle, Abtwil (CH); Mark Steinemann, Hofstetten (CH)

(73) Assignee: GEMA SWITZERLAND GMBH, St. Gallen (CH)

( * ) Notice: Subject to any disclaimer, the term of this patent is extended or adjusted under 35 U.S.C. 154(b) by 389 days.

(21) Appl. No.: 14/001,165

(22) PCT Filed: Feb. 23, 2012

(86) PCT No.: PCT/US2012/026245
§ 371 (c)(1),
(2), (4) Date: Oct. 29, 2013

(87) PCT Pub. No.: WO2012/116136
PCT Pub. Date: Aug. 30, 2012

(65) Prior Publication Data

US 2014/0048015 A1 Feb. 20, 2014

(30) Foreign Application Priority Data

Feb. 23, 2011 (DE) ..... 10 2011 004 595

(51) Int. Cl.
*B05B 5/16* (2006.01)
*B05B 7/14* (2006.01)
(Continued)

(52) U.S. Cl.
CPC ..... *B05B 5/16* (2013.01); *B05B 5/1683* (2013.01); *B05B 7/1445* (2013.01);
(Continued)

(58) Field of Classification Search
None
See application file for complete search history.

(56) References Cited

U.S. PATENT DOCUMENTS 1,358,920 A * 11/1920 Baldwin ..... A47J 43/22 209/355
2,880,871 A * 4/1959 Bruninghaus ..... B07B 1/346 209/310
(Continued)

FOREIGN PATENT DOCUMENTS

DE 10145448 A1 5/2003
DE 10353968 A1 7/2005
(Continued)

OTHER PUBLICATIONS

Corresponding International Application No. PCT/US2012/026245 Written Opinion and Search Report dated Jun. 11, 2012.

*Primary Examiner* — Charles Capozzi
(74) *Attorney, Agent, or Firm* — Kinney & Lange, P.A.

(57) ABSTRACT

The invention relates to a screen insert (70) for a powder container (24) of a powder supplying device, the screen insert (70) having a screen unit (71) for screening coating powder and an ultrasonic transducer (72) for generating ultrasonic vibrations. The screen unit (71) is connected to the ultrasonic transducer (72) in such a way that the ultrasonic vibrations generated by the ultrasonic transducer (72) can be transferred to the screen unit (71). To allow a particularly compact construction of the screen insert (70) to be achieved, according to the invention a screen carrier (73) which can be placed onto the powder container (24) is provided, for holding the ultrasonic transducer (72), with the screen unit (71) connected thereto, in such a way that the screen unit (71) is arranged below the screen carrier (73), so that the screen unit (71) is inside a powder chamber (22), formed by the powder container (24), when the screen carrier (73) has been placed onto the powder container (24).

20 Claims, 5 Drawing Sheets

(51) Int. Cl.
*B05B 15/04* (2006.01)
*B05B 15/12* (2006.01)

(52) U.S. Cl.
CPC ..... *B05B 7/1454* (2013.01); *B05B 7/1472* (2013.01); *B05B 15/0412* (2013.01); *B05B 15/1248* (2013.01); *B05B 15/1285* (2013.01); *B05B 7/1477* (2013.01); *B05B 15/1288* (2013.01); *B07B 2230/04* (2013.01)

(56) References Cited

U.S. PATENT DOCUMENTS

| | | | | |
|---|---|---|---|---|
| 4,108,334 | A * | 8/1978 | Moller | B29C 47/1009 222/136 |
| 6,508,610 | B2 | 1/2003 | Dietrich | |
| 2006/0193704 | A1 | 8/2006 | Simontacchi | |
| 2006/0266284 | A1 * | 11/2006 | Fritz | B07B 1/28 118/308 |

FOREIGN PATENT DOCUMENTS

| | | | |
|---|---|---|---|
| DE | 102007005306 | A1 | 8/2008 |
| EP | 0412289 | A2 | 2/1991 |
| EP | 1342505 | A1 | 9/2003 |
| EP | 2374546 | A1 | 10/2011 |
| WO | 2005051549 | A1 | 6/2005 |
| WO | 2006033813 | A2 | 3/2006 |

* cited by examiner

SCREEN INSERT FOR A POWDER CHAMBER OF A POWDER SUPPLYING DEVICE

RELATED APPLICATIONS

The present application is a National Phase of International Application Number PCT/US2012/026245, filed, Feb. 23, 2012, and claims priority from, German Application Number 102011004595.3, filed Feb. 23, 2011.

The invention relates to a screen insert according to the preamble of independent patent claim 1.

Accordingly, the invention relates in particular to a screen insert for a powder container of a powder supplying device, the screen insert having a screen unit for screening coating powder and an ultrasonic transducer for generating ultrasonic vibrations, the screen unit being connected to the ultrasonic transducer in such a way that the ultrasonic vibrations generated by the ultrasonic transducer can be transferred to the screen unit.

With the increasing quality requirements in powder coating, the screening technique is playing an increasingly important role. It is known in this connection from powder coating technology to use ultrasonic screening systems, which are particularly distinguished by their high screening performance in comparison with classical vibration screens. The screening of the coating powder is intended to separate out contaminants from the coating powder and break up or keep back agglomerations of powder that may occur in particular as a result of mechanical action during the conveying of coating powder. It is intended in this way to ensure that, in the powder coating mode, the coating powder is always fed to the powder spraying device with a consistent high quality.

The screen insert according to the invention is suitable in particular for supplying power to a powder coating installation which is used for the electrostatic spray coating of objects with powder and in which fresh coating powder (hereafter also referred to as "fresh powder") and possibly recovered coating powder (hereafter also referred to as "recovery powder") are located in the powder container and are fed to a spraying device by a powder discharge device, for example in the form of an injector. The spraying device may be, for example, a handheld gun or an automatic gun.

As and when required, fresh powder is fed from a supplier's container, in which the powder supplier supplies the fresh powder to the powder user, to the powder container by way of a fresh powder line.

In the supplier's container, the powder forms a compact mass. By contrast, the coating powder in the powder container should be in a fluidized state, in order for example that it can be sucked out by the suction effect of an injector and fed to the spraying device in a stream of compressed air. A powder supplying device consequently includes in particular a powder container which serves as a powder chamber for keeping coating powder, the coating powder usually being fluidized in the powder container in order that it can be pneumatically conveyed easily, either to another powder container or to a powder spraying device. As already stated, the powder spraying device may be a manual or automatic powder spraying device, which may have a spray nozzle or a rotary atomizer.

The invention is based on the object of making the powder feed to a powder spraying device more effective, with the intention in particular that the powder that is fed is of a consistent high quality.

This object is achieved according to the invention by the features of independent patent claim 1.

Accordingly, the invention relates to a screen insert for a powder container of a powder supplying device, the screen insert having a screen unit for screening coating powder and an ultrasonic transducer for generating ultrasonic vibrations, the screen unit being connected to the ultrasonic transducer in such a way that the ultrasonic vibrations generated by the ultrasonic transducer can be transferred to the screen unit. The invention is particularly distinguished by the compact construction of the ultrasonic screen insert. For this purpose, according to the invention a screen carrier which can be placed onto the powder container is provided, serving and designed for holding the ultrasonic transducer, with the screen unit connected thereto, in such a way that the screen unit is arranged below the screen carrier, so that the screen unit is inside a powder chamber, formed by the powder container, when the screen carrier has been placed onto the powder container.

The object according to the invention is also achieved by a powder supplying device for a powder coating installation, the powder supplying device having at least one powder container with a powder chamber for coating powder, and the at least one powder container being assigned a screen insert of the aforementioned type, the screen carrier of the screen insert being configured as a cover 23, matching the powder container, and being placed or able to be placed onto the powder container in such a way that the screen unit of the screen insert is inside the powder chamber defined by the powder container.

The advantages that can be achieved with the solution according to the invention are obvious: in particular, an ultrasonic screen insert that can be integrated as an operational unit in a powder container is provided. The powder container is preferably a fluidized powder container, i.e. a powder container which has a fluidizing device for introducing fludizing compressed air into the powder chamber. In this case, it is of advantage if the powder container has at least one outlet, leading out of the powder chamber, in order to be able to discharge the fludizing compressed air introduced into the powder chamber and thereby automatically create a pressure equalization. Of course, the screen insert according to the invention is suitable not only in connection with a fluidized powder container. Rather, it is equally conceivable to integrate the screen insert according to the invention in a non-fluidized powder container.

Since, in the case of the screen insert according to the invention, the screen unit that serves for screening the coating powder is arranged below the screen carrier and is connected to this screen carrier in such a way that the screen unit is inside the powder chamber of the powder container when the screen carrier has been placed onto the powder container, this provides a compactly configured screen unit which can be placed as a subassembly onto the powder container, in order to integrate the screen unit that can be excited by ultrasonic vibrations in the powder chamber of the powder container.

In a preferred implementation of the solution according to the invention, it is provided that the screen unit is connected to the ultrasonic transducer by way of an angle connection, in particular an L-shaped angle connection, the ultrasonic transducer being fastened to the screen carrier. The screen carrier is preferably formed as a container cover 23, matching the powder container, so that the screen carrier can be used instead of a conventional standard container cover 23*s* for covering the powder container. As already stated, the screen unit of the screen insert is then inside the powder chamber.

In this connection, it is of advantage if a fastening device, in particular a quick-action clamping means, such as for instance a vertical clamping means, is also provided, in order to fix the screen carrier, formed as a container cover 23, in relation to the powder container in the state in which it has been placed onto the powder container. Of course, however, other embodiments come into consideration for releasably fixing the screen carrier.

In a preferred configuration of the screen unit it is provided that it has a screen frame, surrounding a screen area, and a screen, held by the screen frame, the ultrasonic transducer being connected to the screen frame. It is conceivable here that the screen comprises a screen mesh with a previously specifiable or specified mesh width, the screen mesh preferably being releasably fastened to the screen frame (clamped on).

It should be noted here that the screen mesh width of the screen can be kept very small in comparison with the screen mesh width of conventional vibration screens, since according to the invention the screen is excited by ultrasonic vibrations. In this way, particularly fine screening of the coating powder can be carried out. In particular, possible contaminants and/or agglomerations of powder that may occur as a result of mechanical action during the conveying of coating powder can be effectively kept back or broken up by the screen of the screen insert.

The fact that, according to the invention, the screen insert is configured as a compact subassembly, with the screen carrier of the screen insert being used instead of a conventional container cover 23*s* and in this way allowing the screen unit to be integrated in the powder chamber, makes it possible that the coating powder is screened directly upstream of the powder injectors, so that there is no need for other screening devices, such as for instance screening devices in the lower powder run-out region of a cyclone separator. In other words, the screen insert according to the invention makes it possible that the screening of the coating powder can be performed in the fluidized powder container, that is to say directly before the fluidized powder is fed to the powder spraying devices by way of a powder supply line.

Exemplary embodiments of the solution according to the invention are described below with reference to the accompanying drawings, in which:

FIG. 1 schematically shows a powder coating installation with a powder supplying device according to the invention;

Figure 5A:
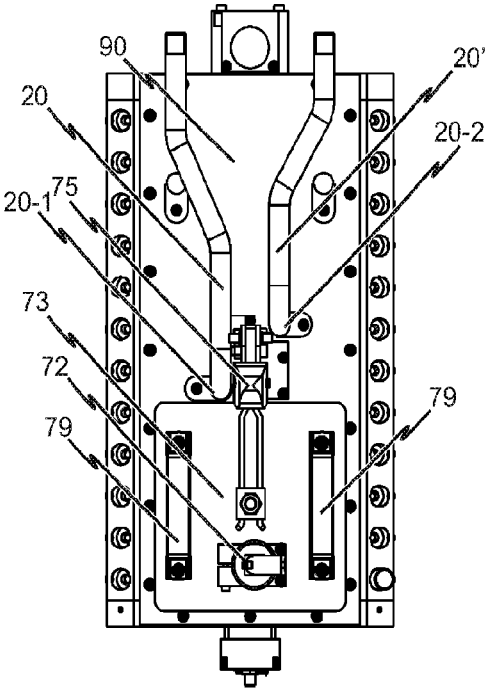
Figure 5B:
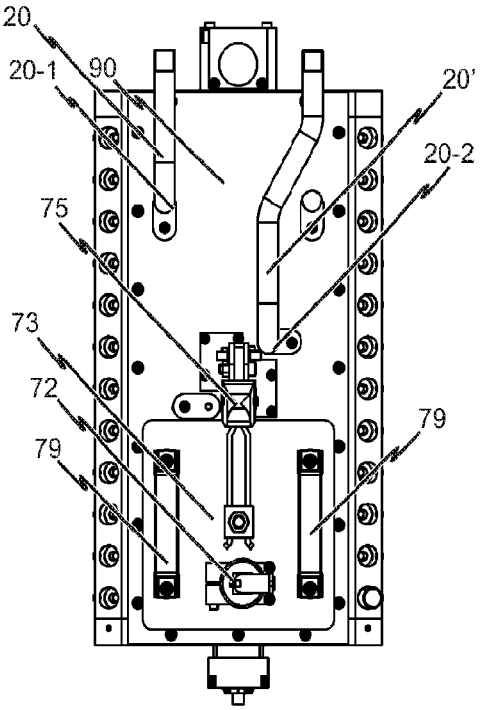
Figure 5C:
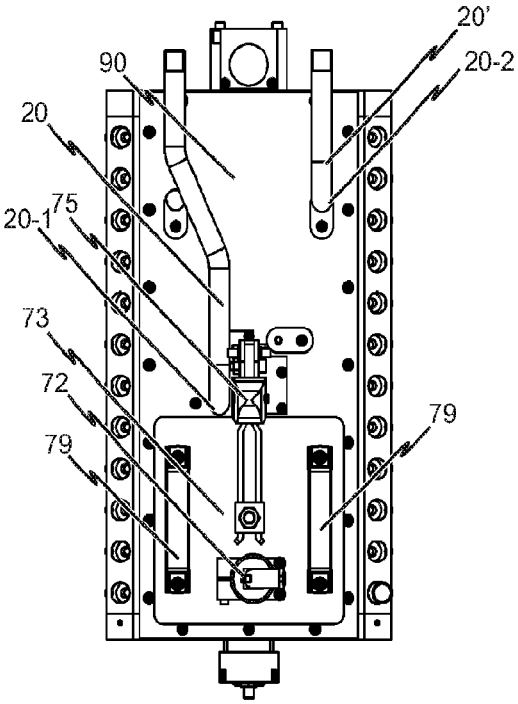
Figure 5D:
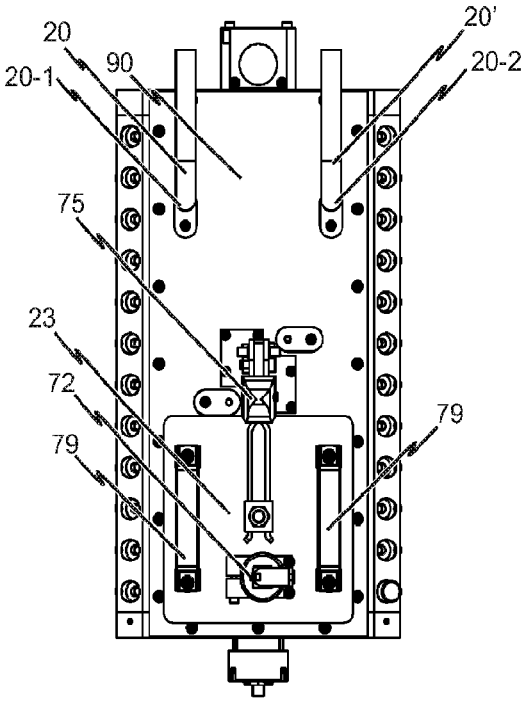

FIG. 5*a* shows a plan view of a powder container with a screen insert according to the invention for the screening of fresh powder and recovery powder;

FIG. 5*b* shows a plan view of a powder container with a screen insert according to the invention for the screening of fresh powder only;

FIG. 5*c* shows a plan view of a powder container with a screen insert according to the invention for the screening of recovery powder only; and FIG. 5*d* shows a plan view of a conventional powder container without a screen insert.

Figure 1:
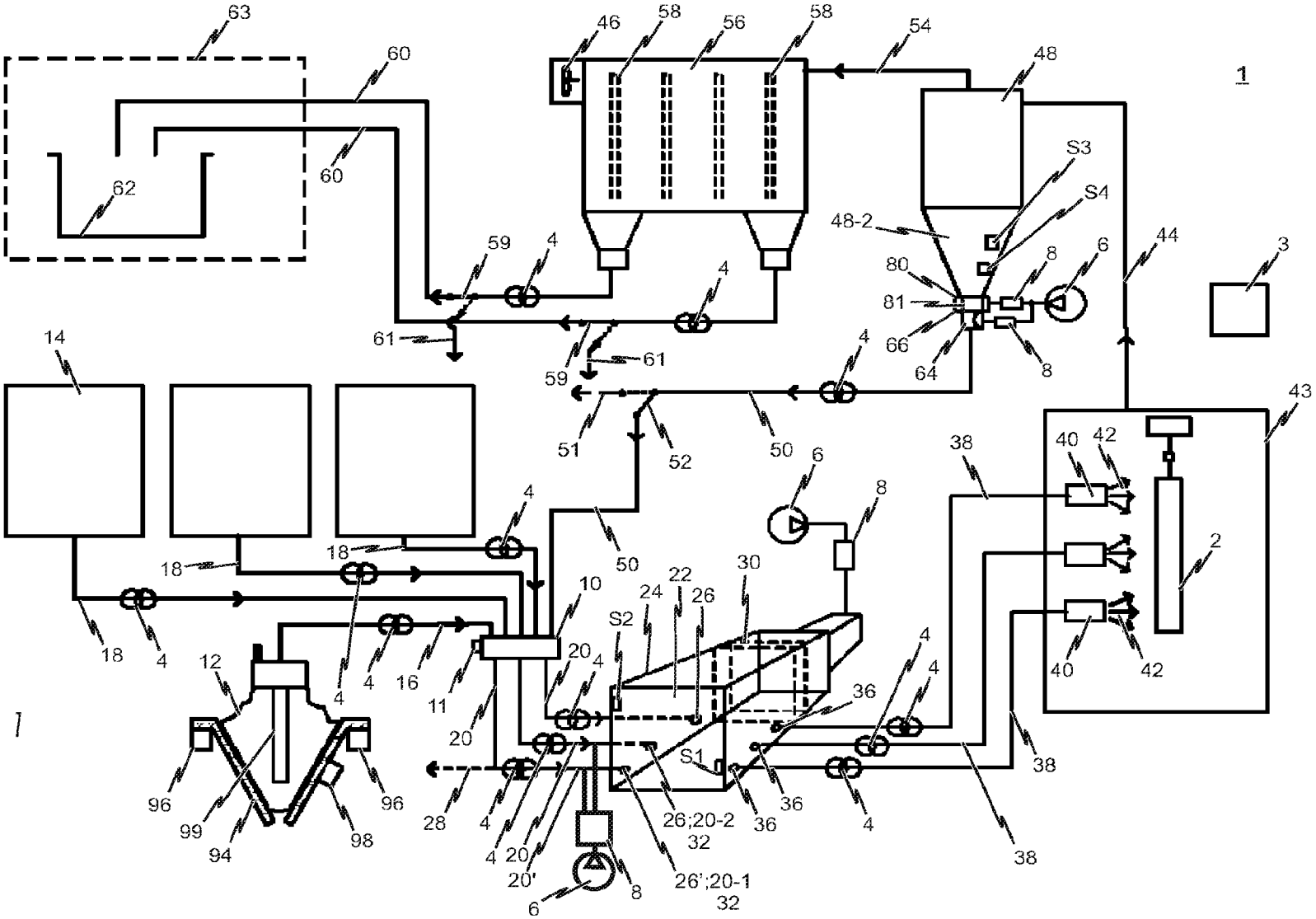

FIG. 1 schematically shows an exemplary embodiment of a powder coating installation 1 for the spray coating of objects 2 with coating powder, which after that is fused onto the objects 2 in a heating furnace not represented in FIG. 1. One or more electronic control devices 35 are provided for controlling the function of the powder coating installation 1.

Powder pumps 4 are provided for pneumatically conveying the coating powder. These pumps may be injectors into which coating powder is sucked out of a powder container by means of compressed air serving as conveying air, after which the mixture of conveying air and coating powder together flows into a container or to a spraying device.

Suitable injectors are known, for example, from the document EP 0 412 289 B1.

It is possible also to use as the powder pump 4 those types of pump which convey small portions of powder one after the other by means of compressed air, a small portion of powder (amount of powder) being respectively stored in a powder chamber and then forced out of the powder chamber by means of compressed air. The compressed air remains behind the portion of powder and pushes the portion of powder in front of it. These types of pump are sometimes referred to as compressed-air feed pumps or plug-conveying pumps, since the compressed air pushes the stored portion of powder in front of it through a pump outlet line like a plug. Various types of such powder pumps for conveying dense coating powder are known, for example, from the following documents: DE 103 53 968 A1, U.S. Pat. No. 6,508,610 B2, US 2006/0193704 A1, DE 101 45 448 A1 or WO 2005/051549 A1.

To generate the compressed air for the pneumatic conveyance of the coating powder and to fluidize the coating powder, a compressed air source 6 is provided, connected to the various devices by way of corresponding pressure setting elements 8, for example pressure controllers and/or valves.

Fresh powder from a powder supplier is fed from a supplier's container, which may be for example a small container 12, for example in the form of a dimensionally stable container or a sack with an amount of powder of for example between 10 and 50 kg, for example 35 kg, or for example a large container 14, for example likewise a dimensionally stable container or a sack, with an amount of powder between for example 100 kg and 1000 kg, by means of a powder pump 4 in a fresh powder line 16 or 18 to a screening device 10. The screening device 10 may be provided with a vibrator 11.

In the following description, the expressions "small container" and "large container" each mean both a "dimensionally stable container" and a "not dimensionally stable, flexible sack", unless reference is expressly made to one or the other type of container.

The coating powder screened by the screening device 10 is conveyed by gravitational force, or preferably in each case by a powder pump 4, by way of one or more powder supply lines 20, 20' through powder-inlet openings 26, 26' into a powder chamber 22 of a dimensionally stable powder container 24. The volume of the powder chamber 22 is preferably much smaller than the volume of the small fresh-powder container 12.

However, the provision of a screening device 10 in the fresh powder line 16 or 18 is not absolutely necessary, but only optional. The use of a screen insert 70, which is not explicitly represented in FIG. 1 and in which a screen unit 71 that is excited or can be excited by ultrasonic waves is inside the powder chamber 22, formed by the powder container 24, in such a way that the coating powder fed to the powder chamber 22 is screened in the powder container 24 makes it possible to dispense with a screening device 10 in the fresh powder line 16 or 18. This simplifies the structure of the powder coating installation 1, which is noticeable in particular in the event of a change of powder, since the screen insert 70—unlike a screening device 10 provided in the fresh powder line 16 or 18—can be cleaned with little expenditure of time.

Embodiments of the screen insert 70 that are not explicitly represented in FIG. 1 for reasons of clarity are described later with reference to the representations in FIGS. 3 to 5*a-c*.

It is conceivable that the powder pump 4 of the at least one powder supply line 20, 20' to the powder container 24 is formed as a compressed-air feed pump.

Here, the initial portion of the powder supply line 20 may serve as a pump chamber into which powder screened by the screening device 10 optionally falls through a valve, for example a pinch valve. Once this pump chamber contains a certain portion of powder, the powder supply line 20 is isolated in terms of flow by closing the valve of the screening device 10. After that, the portion of powder is pushed into the powder chamber 22 by means of compressed air through the powder supply line 20, 20'.

Powder pumps 4, for example injectors, for conveying coating powder through powder lines 38 to spraying devices 40 are connected to one or preferably a number of powder outlet opening(s) 36 of the powder container 24. The spraying devices 40 may be spray nozzles or rotary atomizers for spraying the coating powder 42 onto the object 2 to be coated, which is preferably located in a coating cubicle 43.

The powder outlet openings 36 may be located—as represented in FIG. 1—in a wall of the powder container 24 that lies opposite the wall in which the powder inlet openings 26, 26' are located. In the case of the embodiments of the powder container 24 represented in FIG. 3 and FIGS. 5*a-d*, however, the powder inlet openings 26, 26' are respectively arranged in a top wall of the powder container 24, so that the coating powder is fed from above to the powder chamber 22, and in particular to the screen unit 71 of the screen insert 70 that is integrated in the powder chamber 22.

The powder outlet openings 36 are preferably arranged near the bottom of the powder chamber 22.

The powder chamber 22 is preferably of a size that lies in the range of a coating powder capacity of between 1.0 kg and 12.0 kg, preferably between 2.0 kg and 8.0 kg. According to other aspects, the size of the powder chamber 22 is preferably between 500 $cm^3$ and 30 000 $cm^3$, preferably between 2000 $cm^3$ and 20 000 $cm^3$. The size of the powder chamber 22 is chosen in dependence on the number of powder outlet openings 36 and the powder lines 38 connected thereto, in such a way that continuous spray coating operation is possible, but the powder chamber 22 can be quickly cleaned, preferably automatically, during coating breaks for changing the powder.

The powder chamber 22 may be provided with a fluidizing device 30 for fluidizing the coating powder received in the powder container 24. The fluidizing device 30 contains at least one fluidizing wall of a material with open pores or provided with narrow bores, which is permeable to compressed air but not to coating powder. Although not shown in FIG. 1, it is of advantage if in the case of the powder container 24 the fluidizing wall forms the bottom of the powder container 24 and is arranged between the powder chamber 22 and a fluidizing compressed-air chamber. The fluidizing compressed-air chamber should be able to be connected to the compressed air source 6 by way of a pressure setting element 8.

Coating powder 42 that does not adhere to the object 2 to be coated is sucked into a cyclone separator 48 as excess powder by means of a stream of suction air of a blower 46 by way of an excess powder line 44. In the cyclone separator 48, the excess powder is separated as far as possible from the stream of suction air. The separated powder fraction is then conducted as recovery powder from the cyclone separator 48 by way of a powder recovery line 50 to the optionally provided screening device 10, where it passes through the screening device 10, either alone or mixed with fresh powder, by way of the powder supply lines 20, 20' back into the powder chamber 22.

As already indicated, it is possible to dispense with the screening device 10 if, according to the invention, the powder container 24 is provided with a screen insert 70, so that the fresh powder and/or recovery powder fed to the powder chamber 22 is screened by the screen insert 71 integrated in the powder chamber 22. The screening of the coating powder (fresh powder and/or recovery powder) fed to the powder container 24 inside the powder chamber 22, and consequently directly before the coating powder is conveyed by way of powder pumps 4, in particular injectors, through powder lines 38 to the spraying devices 40, guarantees a consistent high quality of the coating powder that is fed to the spraying devices 40.

Depending on the kind of powder and/or the degree of powder contamination, the possibility of isolating the powder recovery line 50 from the optionally provided screening device 10 and conducting the recovery powder into a waste container may also be provided, as schematically represented in FIG. 1 by a dashed line 51. In order that it need not be isolated from the optionally provided screening device 10, the powder recovery line 50 may be provided with a diverter 52, at which it can be connected alternatively to the optionally provided screening device 10 or to a waste container.

The powder container 24 may have one or more, for example two, sensors S1 and/or S2, in order to control the supply of coating powder into the powder chamber 22 by means of the control device 3 and the powder pumps 4 in the powder supply lines 20, 20'. For example, the lower sensor S1 detects a lower powder level limit and the upper sensor S2 detects an upper powder level limit.

The lower end portion 48-2 of the cyclone separator 48 may be formed and used as a storage container for recovery powder and provided for this purpose with one or more, for example two, sensors S3 and/or S4, which are functionally connected to the control device 3. This allows, for example, the feeding of fresh powder through the fresh powder supply lines 16 and 18 to be automatically stopped as long as there is sufficient recovery powder in the cyclone separator 48 to feed recovery powder to the powder chamber 22 in a sufficient amount required for the spray coating operation by means of the spraying devices 40. If there is no longer sufficient recovery powder in the cyclone separator 48, it is possible to switch over automatically to the feeding of fresh powder through the fresh powder supply lines 16 or 18. Furthermore, there is also the possibility of feeding fresh powder and recovery powder to the optionally provided screening device 10 or the pump chamber 22 at the same time, so that they are mixed with each other.

The exhaust air of the cyclone separator 48 passes by way of an exhaust-air line 54 into an after-filtering device 56 and through one or more filter elements 58 therein to the blower 46 and after that into the outside atmosphere. The filter elements 58 may be filter bags or filter cartridges or filter plates or similar filter elements. The powder separated from the stream of air by means of the filter elements 58 is normally waste powder and falls by gravitational force into a waste container or, as shown in FIG. 1, may be conveyed by way of one or more waste lines 60, which each contain a powder pump 4, into a waste container 62 at a waste station 63.

Depending on the kind of powder and the powder coating conditions, the waste powder may also be recovered again, to re-enter the coating cycle. This is schematically represented in FIG. 1 by diverters 59 and branch lines 61 of the waste lines 60.

In the case of multi-color operation, in which different colors are respectively sprayed only for a short time, the cyclone separator 48 and the after-filtering device 56 are usually used and the waste powder of the after-filtering device 56 passes into the waste container 62. Although the powder separating efficiency of the cyclone separator 48 is usually less than that of the after-filtering device 56, it can be cleaned more quickly than the after-filtering device 56. In the case of single-color operation, in which the same powder is used for a long time, it is possible to dispense with the cyclone separator 48 and to connect the excess powder line 44 to the after-filtering device 56 instead of the exhaust-air line 54, and to connect the waste lines 60, which in this case contain powder to be recovered, as recovery powder lines by way of the optionally provided screening device 10 or directly to the powder container 24.

In the case of single-color operation, the cyclone separator 48 is usually only used in combination with the after-filtering device 56 when a problematic coating powder is involved. In this case, only the recovery powder of the cyclone separator 48 is fed by way of the powder recovery line 50 and optionally by way of the screening device 10 or directly to the screen unit 71 integrated in the powder chamber 22 (cf. FIG. 3), while the waste powder of the after-filtering device 56 passes as waste into the waste container 62 or into some other waste container, which latter can be placed directly under an outlet opening of the after-filtering device 56 without waste lines 60.

The lower end of the cyclone separator 48 may have an outlet valve 64, for example a pinch valve. Furthermore, a fluidizing device 66 for fluidizing the coating powder may be provided above this outlet valve 64, in or at the lower end of the lower end portion 48-2, formed as a storage container, of the cyclone separator 48. The fluidizing device 66 contains at least one fluidizing wall 80 of a material which has open pores or is provided with narrow bores and is permeable to compressed air but not to coating powder. The fluidizing wall 80 is arranged between the powder path and a fluidizing compressed-air chamber 81. The fluidizing compressed-air chamber 81 can be connected to the compressed air source 6 by way of a pressure setting element 8.

The fresh powder line 16 and/or 18 may be connected in terms of flow at its upstream end, either directly or through the powder pump 4, to a powder conveying tube 99, which can be immersed in the supplier's container or 14 for sucking out fresh coating powder. The powder pump 4 may be arranged at the beginning, at the end or in between in the fresh powder line 16 or 18 or at the upper or lower end of the powder conveying tube 99.

FIG. 1 shows as a small fresh-powder container a fresh-powder powder sack 12 in a sack receiving hopper 94. The powder sack 12 is kept in a defined form by the sack receiving hopper 94, the sack opening being located at the upper end of the sack. The sack receiving hopper 94 may be arranged on a balance or weighing sensors 96. This balance or the weighing sensors 96 may, depending on the type, produce an optical display and/or generate an electrical signal, which after deducting the weight of the sack receiving hopper 94 corresponds to the weight, and consequently also the amount, of the coating powder in the small container 12. At least one vibrating vibrator 98 is preferably arranged on the sack receiving hopper 94.

Two or more small containers 12 each in a sack receiving hopper 94 and/or two or more large containers 14, which can be alternatively used, may be provided. As a result, a quick change from one to another small container 12 or large container 14 is possible.

Although not shown in FIG. 1, it is provided according to the invention that the powder container 24 is assigned a screen insert 70, which is described below with reference to the representations in FIGS. 3 and 4. This screen insert 70 has a screen unit 71 for screening coating powder and an ultrasonic transducer for generating ultrasonic vibrations, the screen unit 71 being connected to the ultrasonic transducer 72 in such a way that the ultrasonic vibrations generated by the ultrasonic transducer 72 can be transferred to the screen unit 71. The screen insert 70 is assigned a screen carrier 73, which can be placed onto the powder container 24 and serves for holding the ultrasonic transducer 72, with the screen unit 71 connected thereto, in such a way that the screen unit 71 is arranged below the screen carrier 73, so that the screen unit 71 is within the powder chamber 22 of the powder container 24 when the screen carrier 73 has been placed onto the powder container 24.

In the case of the embodiments represented in FIGS. 3, 4 and 5*a-c*, the screen carrier 73 of the screen insert 70 is in each case configured as a cover 23, matching the powder container 24, and is placed or able to be placed onto the powder container 24 in such a way that the screen unit 71 of the screen insert 70 is inside the powder chamber 22 defined by the powder container 24.

An exemplary embodiment of a powder container 24 of a powder supplying device for a powder coating installation 1 is described in detail below with reference to the representations in FIGS. 2 and 3. The powder container 24 shown in FIG. 3 is suitable in particular as a component part of the powder coating installation 1 described above with reference to the representation in FIG. 1.

Figure 2:
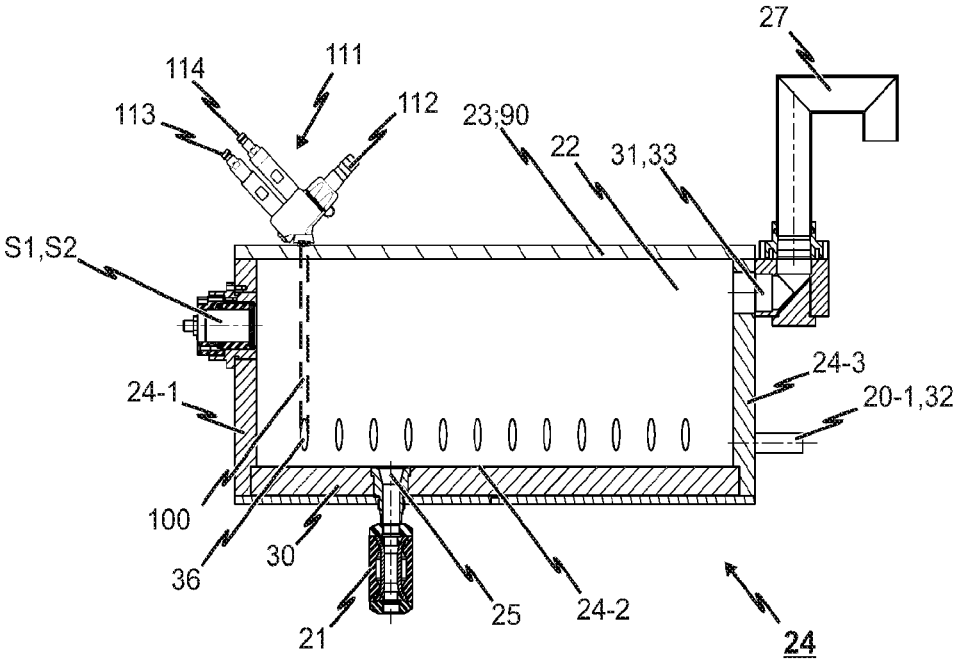
FIG. 2 shows a longitudinal sectional side view of a conventional powder container without a screen insert.

As represented in FIG. 2, the exemplary embodiment is a powder container 24 which is closed or can be closed with a cover 23, the cover 23 preferably being able to be connected to the powder container 24 by way of a quickly releasable connection. Specifically, in the case of the powder container 24 according to FIG. 2 it is provided that the entire upper top wall 90 of the powder container 24 can be removed in order to open the powder container 24. Accordingly, in the case of the embodiment shown in FIG. 2, the entire upper top wall 90 of the powder container 24 represents the powder container cover 23. As described below with reference to FIG. 3, it is also conceivable, however, that an opening 91 for receiving a container cover 23 is formed in the upper top wall or covering surface 90. In the case of this modification, consequently, it is not the entire upper top wall 90 of the powder container 24 that represents the powder container cover 23, but the component that fits in the container cover opening 91 to close it.

Figure 3:
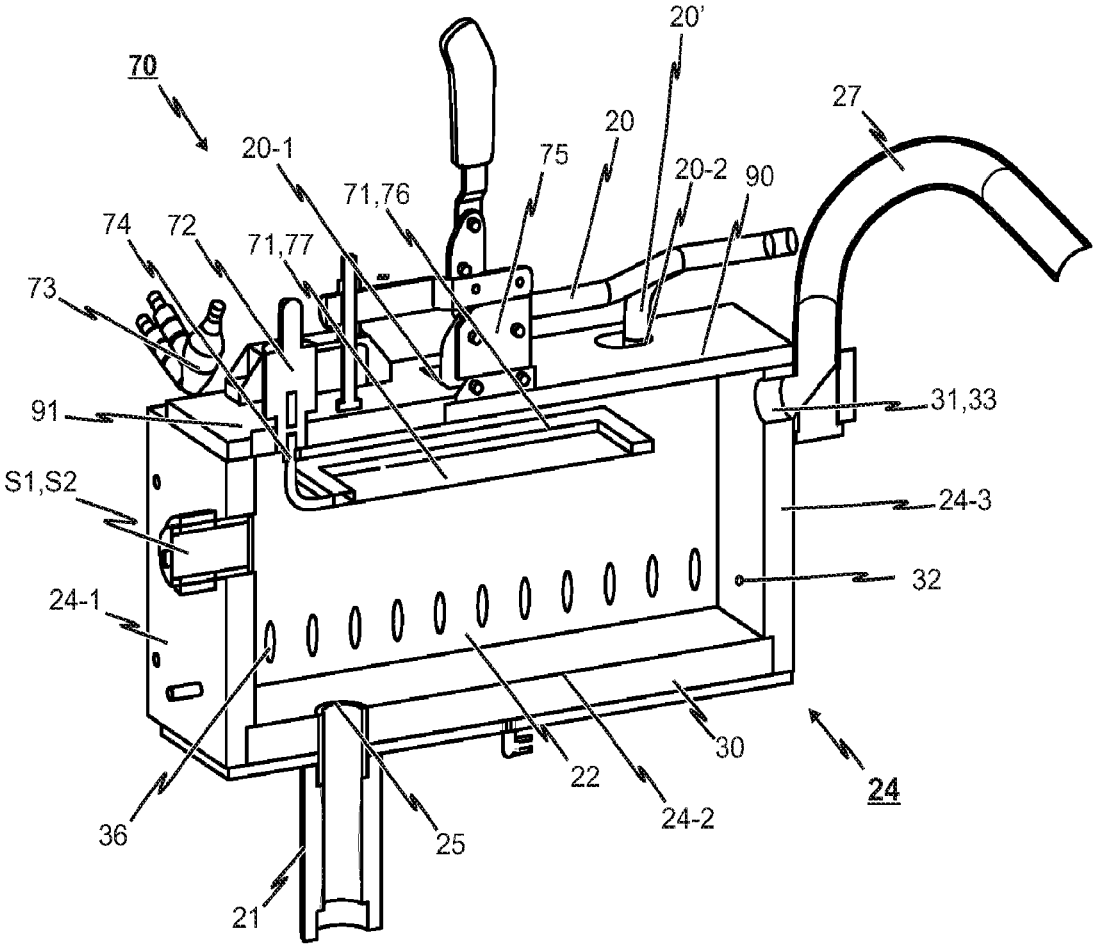
FIG. 3 shows a perspective longitudinal sectional view of a powder container with a screen insert according to an exemplary embodiment of the solution according to the invention.

The powder containers 24 represented in FIG. 2 and FIG. 3 each have a substantially cuboidal powder chamber 22 for receiving coating powder. Provided in a side wall 24-3 of the powder container 24 is at least one cleaning compressed-air inlet 32, to which a compressed air source 6 can be connected in a cleaning mode of the powder coating installation 1 for removing residual powder from the powder chamber 22 by way of a compressed-air line, in order to introduce cleaning compressed air into the powder chamber 22. Also provided on the already mentioned side wall 24-3 of the powder container 24 is a residual powder outlet 33, which has an outlet opening by way of which residual powder can be driven out of the powder chamber 22 in the cleaning mode of the powder coating installation 1 with the aid of the cleaning compressed air introduced into the powder chamber 22.

In the case of the exemplary embodiment represented in FIG. 2, it is provided that the inlet opening of the cleaning compressed-air inlet 32 serves in the powder coating mode of the powder coating installation 1 as a powder inlet opening to which there can be connected, outside the powder chamber 22, powder supply lines 20, 20' for the feeding, as and when required, of coating powder into the powder chamber 22. Of course, it is also conceivable, however, to provide in addition to the cleaning compressed-air inlet 32 one or more separate powder inlets 20-1, 20-2 in the case of the powder chamber 24 according to FIG. 2.

In this connection, reference should be made to the representation in FIG. 3. In the case of this embodiment—as also in the case of the powder container according to FIG. 2—at least one cleaning compressed-air inlet 32 is provided in a side wall 24-3 of the powder container 24. In addition to this there is in the upper covering surface 90 of the powder container 24 at least one powder feed opening 20-1, 20-2, which is connected or can be connected to a powder supply line 20, 20', for feeding coating powder, in particular fresh powder and/or recovery powder, to the powder chamber 22, defined by the powder container 24.

Of course, however, it is also conceivable that, in the powder coating mode of the powder coating installation 1, both recovery powder and fresh powder can be fed, as and when required, by way of the inlet opening from one and the same powder inlet 20-2, 20-1.

In the case of both embodiments represented in FIG. 2 and FIG. 3, a fluidizing device 30 for introducing fluidized compressed air into the corresponding powder chamber 22 is preferably provided in each case. The fluidizing compressed air may be introduced into the powder chamber 22 through an end wall, longitudinal side wall, bottom wall or top wall. According to the embodiment represented, the bottom wall 24-2 of the powder chamber 22 is formed as a fluidizing bottom. It has a multiplicity of open pores or small through-openings, through which fluidizing compressed air from a fluidizing compressed-air chamber arranged underneath the bottom wall can flow upward into the powder chamber 22, in order therein to put the coating powder into a suspended state (fluidize it) in the powder coating mode of the powder coating installation 1, in order that it can easily be sucked out with the aid of a powder discharge device. The fluidizing compressed air is fed to the fluidizing compressed-air chamber through a fluidizing compressed-air inlet.

In order that, during the operation of the fluidizing device 30, the pressure within the powder chamber 22 does not exceed a previously specified maximum pressure, the powder chamber 22 has at least one fluidizing compressed-air outlet 31 with an outlet opening for removing the fluidizing compressed air introduced into the powder chamber 22 and for bringing about a pressure equalization. In particular, the outlet opening of the at least one fluidizing compressed-air outlet 31 should be dimensioned in such a way that, during the operation of the fluidizing device 30, there is in the powder chamber 22 a positive pressure of at most 0.5 bar with respect to atmospheric pressure.

In the case of the embodiments represented in FIGS. 2 and 3, the outlet opening of the residual powder outlet 33 is identical in each case to the outlet opening of the fluidizing compressed-air outlet 31. Of course, however, it is also possible that the fluidizing compressed-air outlet 31 is, for example, provided in the cover 23 or in the upper top wall 90 of the powder container 24.

As revealed particularly by the representation in FIG. 2, in the case of the embodiment shown the fluidizing compressed-air outlet 31 has a venting line, which is connected or can be connected outside the powder chamber 22 to a rising pipe 27, in order to prevent a powder emission from the powder chamber 22 during the powder coating operation of the powder coating installation 1.

For removing the fluidizing compressed air introduced into the powder chamber 22, it is also conceivable to provide a venting line which preferably protrudes into the upper region of the powder chamber 22. The protruding end of the venting line may protrude into an intake funnel of an extraction installation. This extraction installation may be configured for example as a booster (air mover). A booster, which is also known as an "air mover", operates on the basis of the Coanda effect and requires for its drive customary compressed air, which must be supplied in a small amount. This amount of air has a higher pressure than the ambient pressure. The booster produces in the intake funnel an air flow of high velocity, with great volume and low pressure. Therefore, a booster is particularly well suited in connection with the venting line or the fluidizing compressed-air outlet 31.

In the case of the exemplary embodiment represented in FIG. 2 and FIG. 3, the powder container 24 has in each case a contactlessly operating level sensor S1, S2, in order to detect the maximum permissible powder level in the powder chamber 22. It is conceivable here to provide a further level sensor, which is arranged with regard to the powder container 24 in such a way as to detect a minimum powder level and, as soon as the powder reaches or falls below this minimum level, to emit a corresponding message to a control device 3, in order to feed fresh powder or recovery powder to the powder chamber 22, preferably automatically, by way of the inlet opening of the at least one powder inlet 20-1, 20-2.

Preferably, the level sensor S1, S2 for detecting the powder level in the powder chamber 22 is a contactlessly operating level sensor and is arranged outside the powder chamber 22, separate from it. As a result, soiling of the level sensor S1, S2 is prevented. The level sensor S1, S2 generates a signal when the powder level has reached a certain height. It is also possible for a number of such powder level sensors S1, S2 to be arranged at different heights, for example for detecting predetermined maximum levels and for detecting a predetermined minimum level.

The signals of the at least one level sensor S1, S2 are preferably used for controlling an automatic powder supply of coating powder through the powder inlets 20-1, 20-2 into the powder chamber 22, in order to maintain a predetermined level or a predetermined level range therein even during the time period while the injectors 111 are sucking coating powder out of the powder chamber 22 and pneumatically conveying it to spraying devices 40 (or into other containers).

During such a powder spray coating mode, cleaning compressed air is not conducted into the powder chamber 22, or is conducted only with reduced pressure.

As revealed by the representation in FIG. 2 or in FIG. 3, in the case of the exemplary embodiments it is respectively provided that in the bottom wall 24-2 of the powder container 24 there is provided a powder outlet 25, which can be opened with the aid of a pinch valve 21 in order, as and when required, to remove coating powder from the powder chamber 22, preferably by gravitational force. This is required in particular whenever, in the event of a change of color or powder, coating powder of the old kind is still present in the powder chamber 22.

The powder container 24 shown in FIG. 2 is equipped with an injector 111, in order to convey coating powder to a spraying device 40 by way of a powder hose 38 connected to the output of the injector 111. Although only one injector 111 is shown in FIG. 2 for reasons of clarity, it goes without saying that a multiplicity of injectors 111 may be connected to the powder container 24, each conveying coating powder to one or more spraying devices 40 by way of a powder hose 38. Instead of injectors 111, other types of powder discharge device may be used, for example powder pumps.

As represented in FIG. 2 and FIG. 3, corresponding powder discharge openings 36 are provided in the chamber walls 24-3 and 24-4 of the respective powder container 24. In the case of the embodiments represented, it is provided that each of the powder discharge openings 36 is connected or can be connected in terms of flow to an associated injector 111 of the powder conveying device 110, in order in the powder coating mode of the powder coating installation 1 to be able to suck coating powder out of the powder chamber 22 and feed it to the spraying devices 40. The powder discharge openings 36 preferably have an elliptical form, so that the effective area for the intake of fluidized coating powder is increased.

The powder discharge openings 36 are arranged as deeply as possible in the powder chamber 22, in order to be able as far as possible to suck out all of the coating powder from the powder chamber 22 by means of the injectors 111. The injectors 111 are preferably located at a point higher than the highest powder level and are respectively connected to one of the powder discharge openings 36 by a powder discharge or powder intake channel 100. The powder discharge openings 36 correspond here to the powder intake openings of the powder intake channels 100. The fact that the injectors 111 are arranged higher than the maximum powder level avoids the coating powder rising up out of the powder chamber 22 into the injectors 111 when the injectors 111 are not switched on.

As represented in FIG. 2, each injector 111 has a conveying gas connection 113 for conveying gas, in particular conveying compressed air, which generates a negative pressure in a negative pressure region of the injector 111 and thereby sucks coating powder through a powder intake opening 36 and the associated powder intake channel 100 out of the powder chamber 22 and then conveys it through a jet-receiving nozzle 112 (powder output) through a powder hose 38 to a receiving point, which may be said spraying device 40 or a further powder container 24. To assist powder conveyance, the injector 111 may be provided with a metering gas or additional gas connection 114 for the feeding of metering gas or additional gas (preferably compressed air) into the stream of conveying air and powder at the powder output.

In the case of the embodiments represented in FIG. 2 and FIG. 3, a multiplicity of injectors 111 may be used, the powder intake channels 100 of the multiplicity of injectors 111 being formed within two opposing side walls 24-3, 24-4 of the powder container 24. Of course, however, it is also conceivable that the powder intake channels 100 are not formed in side walls of the powder container 24 but are formed as powder intake tubes.

Possible embodiments of the solution according to the invention are described below with reference to the representations in FIGS. 3 to 5*c*. Specifically, the powder container 24 according to FIG. 2 is shown in FIG. 3 in a perspective sectional view, although, unlike the powder container represented in FIG. 2, in the case of the embodiment shown in FIG. 3*a* screen insert 70 according to the present invention is used.

As shown, the screen insert 70 has a screen unit 71, which has a screen frame 76, surrounding a screen area S, and a screen 77, held by the screen frame 76. In the case of the embodiment represented, the screen 77 is a screen mesh with a previously specifiable or specified mesh width, the screen mesh preferably being releasably fastened to the screen frame 76.

The screen insert 70 according to the invention also has a screen carrier 73. In the case of the embodiment represented, the screen carrier is configured as a container cover 23, matching the powder container 24 and inserted in the container cover opening 91 of the powder container 24. In the inserted state, the screen carrier 73, configured as a container cover 23, is releasably fixed in the container cover opening 91 of the powder container 24 with the aid of a vertical clamping means 75.

The screen insert 70 according to the invention also has an ultrasonic transducer 72, which can be connected to an ultrasonic generator (not represented). The ultrasonic transducer 72 is connected accessibly from the outside to the screen carrier 73 configured as a container cover 23. In the embodiment represented, the lower end portion of the ultrasonic transducer 72 is inserted in a bore provided in the screen carrier 73 and is fixed there, for example by adhesive bonding. Of course, however, it is also conceivable to connect the ultrasonic transducer 72 releasably to the screen carrier 73. For example, the ultrasonic transducer 72 may have a threaded portion and be able to be screwed into a corresponding counter-thread provided in the screen carrier 73.

Figure 4:
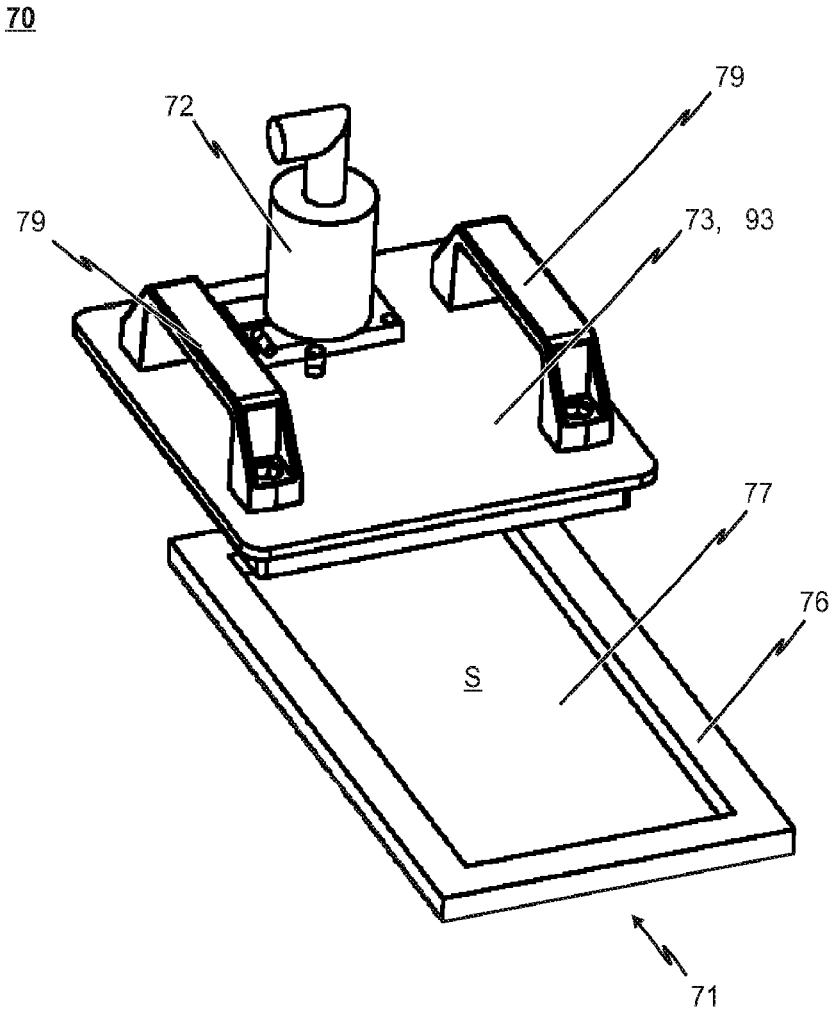
FIG. 4 shows a perspective view of an embodiment of the screen insert according to the invention.

As revealed particularly by the representation in FIG. 4, the screen unit 71, and in particular the screen frame 76 of the screen unit 71, is connected to the ultrasonic transducer 72 by way of a substantially L-shaped angle connection 74. Specifically, the connection between the ultrasonic transducer 72 and the screen unit 71 is chosen such that the ultrasonic vibrations generated by the ultrasonic transducer 72 can be transferred as optimally as possible, i.e. free from loss, to the screen unit 71.

The invention is distinguished by the fact that the screen insert 70 is configured in the form of a compact component which can be inserted into any desired powder container 24 without the powder container 24 having to be structurally modified for this. It is merely required to remove the standard cover 23 or the upper top wall 90 of the powder container 24 and insert the screen carrier 73, configured as a container cover 23, into the cover opening 91 of the powder container 24. In the inserted state (cf. FIG. 3), the screen unit 71 is then integrated within the powder chamber 22, formed by the powder container 24.

In the case of the embodiment represented in FIG. 3, the screen insert 70 according to the invention is used in the case of a fluidized powder container 24. As also described above with reference to the representation in FIG. 2, the powder container 24 represented in FIG. 3 has in particular a fluidizing device 30, by way of which fluidizing compressed air is introduced, as and when required, into the powder chamber 22. Furthermore, an outlet 31, leading out of the powder chamber 22, is provided in order to be able, for the purpose of a pressure equalization, to remove the fluidizing compressed air that has possibly been introduced into the powder chamber 22. Although, in the case of the embodiment represented in FIG. 3, the fluidizing compressed-air outlet 31 is provided in a side wall of the powder container 24, it is of course also conceivable to arrange the fluidizing compressed-air outlet in the upper top wall 90 of the powder container 24.

In the case of the embodiment represented in FIG. 3, the powder chamber 22 of the powder container 24 is fed coating powder by way of two powder feed openings 20-1 and 20-2 configured separately from each other. The powder feed openings 20-1 and 20-2 are respectively provided in the top wall 90 of the powder container 24. Specifically, the powder feed opening 20-1 serves for the feeding of fresh powder, while the powder feed opening 20-2 is used for the feeding of recovery powder. For this purpose, the two powder feed openings 20-1 and 20-2 are each connected to a corresponding powder supply line 20 and 20', respectively.

In FIG. 5*a*, the powder container 24 according to FIG. 3 is shown in a plan view. A comparison of the representations in FIGS. 3 and 4*a* shows that the screen unit 71 is dimensioned and the powder feed opening 20-1 for the feeding of fresh powder is arranged with regard to the screen unit 71 in such a way that the fresh powder fed by way of the fresh-powder feed opening 20-1 does not fall onto the screen area S of the screen unit 71. Only the recovery-powder feed opening 20-2 is arranged with regard to the screen unit 71 in such a way that the recovery powder fed by way of the recovery-powder feed opening 20-2 falls onto the screen area of the screen unit 71.

It is of course also optionally conceivable in this respect, however, that both the recovery powder and the fresh powder are screened by the screen unit 71. In this case, the fresh-powder feed opening 20-1 should be arranged in the top wall of the powder chamber 22 in such a way that the fresh powder fed by way of the fresh-powder feed opening 20-1 also falls onto the screen area S of the screen unit 71 (cf. FIG. 5*b*).

On the other hand, it is also conceivable—as represented in FIG. 5*c*—that only the fresh powder but not the recovery powder is fed to the screen area S. Accordingly, it is also only the fresh-powder feed opening that is arranged with regard to the screen unit 71 in such a way that the fed fresh powder falls onto the screen area S.

In FIG. 5*d*, a powder container 24 with a conventional standard powder container cover 23 is represented in a plan view. A comparison with the representations in FIGS. 5*a* to 5*c* shows directly that the standard powder container cover 23 has the same dimensions as the screen carrier 73 configured as a carrier plate.

On the other hand, however, it is also possible that the screen carrier 73 of the screen unit 70 is made compatible with the upper top wall 90 of the powder container 24. In such a case, a conventional powder container 24, such as that shown for example in FIG. 2, can be easily retrofitted with a screen unit 70, that is by the screen carrier 73, configured as a carrier plate and comprising the ultrasonic transducer 72 and the screen unit 71, being connected, preferably releasably connected (screwed), to the side walls 24-1, 24-2, 24-3, 24-4 of the powder container 24 instead of the upper top wall 90, provided as standard, of the powder container 24. In this case, it is also conceivable that at least one powder feed opening 20-1, 20-2, which is connected or can be connected to a powder supply line 20, 20', is formed in the screen carrier 73, configured as a carrier plate, for the feeding, as and when required, of coating powder, in particular fresh powder and/or recovery powder, to the powder chamber 22.

To make it possible for the screen unit 70 or the screen carrier 73 to be inserted as easily as possible in the container cover opening 91, corresponding handles 79 are preferably provided on the screen carrier 73.

To sum up, the invention proposes an ultrasonic screen or ultrasonic screen insert which can be integrated as an operational unit in a container—preferably a fluidized powder container. In the case of the exemplary embodiment, the ultrasonic screen insert 70 is installed in the powder container 24 of a powder coating installation 1. However, the ultrasonic screen insert 70 according to the invention is suitable for any desired fluidized or non-fluidized powder container.

A fundamental idea of the invention is that a compact ultrasonic screen unit 71 can be accommodated in a fluidized powder container 24. The open construction of the ultrasonic screen unit 71 has the effect of creating an automatic pressure equalization in the vented powder container 24. Trouble-free and consistent powder application is thereby ensured.

The feeding of fresh powder and recovery powder can take place in different variants.

The present invention achieves high-quality screening of the coating powder even in the case of quick color-changing systems with a cyclone separator. All of the screening devices 10 that were previously accommodated in the lower powder run-out region of the cyclone separator or in the powder supply line to the powder container 24 can be eliminated by the provision of the screen unit 70 according to the invention. Relocating the screen unit 71 from the run-out region of the cyclone separator or from the powder supply line into the fluidized powder container 24 achieves the effect of increasing the quality of the powder. In this way, the screening of the powder takes place directly upstream of the injectors 111. As a result, possible contaminants or, for example, platelets or agglomerations of powder that may occur as a result of mechanical action during the conveying of coating powder can be kept back before the injectors 111 in the screen 77.

In addition to this, when ultrasonic screens 77 are used, the screen mesh widths of the screens can be kept very small in comparison with conventional vibration screens. The consequence is a significant increase in the quality of the powder.

This invention also provides the latter in the case of quick color-changing systems with a cyclone separator. The compact construction of this ultrasonic screen insert allows very little expenditure of time to be required for cleaning in the event of a change of color.

The invention is not restricted to the embodiments represented in the drawings, but is made up of all the features disclosed herein considered together.

The invention claimed is:

1. A powder container of a powder supplying device, the powder container having an upper top wall for covering a powder chamber formed by the powder container and an opening formed in the upper top wall, wherein the powder container comprises a container cover that fits in the opening formed in the upper top wall of the powder container for closing the opening, wherein the powder container further comprises a screen insert, said screen insert having a screen unit for screening coating powder and an ultrasonic transducer for generating ultrasonic vibrations, the screen insert being connected to the ultrasonic transducer in such a way that the ultrasonic vibrations generated by the ultrasonic transducer can be transferred to the screen insert, wherein said container cover serves as a screen carrier for holding the ultrasonic transducer, with the screen insert connected thereto, in such a way that the screen insert is arranged below the container cover, so that the screen insert is inside the powder chamber formed by the powder container, when the container cover has been placed into or onto the opening formed in the upper top wall of the powder container, wherein the powder container has at least one powder inlet for the feeding of coating powder into the powder chamber, and wherein the at least one powder inlet is provided in an area of the upper top wall of the powder container that is different from an area of the upper top wall where said opening is formed.

2. The powder container as claimed in claim 1, a clamp for releasably fixing the screen carrier in the state in which it has been placed onto the powder container.

3. The powder container as claimed in claim 1, the screen insert having a screen frame, surrounding a screen area, and the screen, held by the screen frame, the ultrasonic transducer being connected to the screen frame.

4. The powder container as claimed in claim 3, the screen insert comprising a screen mesh with a previously specifiable or specified mesh width.

5. The powder container as claimed in claim 1, wherein the at least one powder feed inlet is connected or can be connected to a powder supply line for feeding coating powder, including fresh powder and/or recovery powder, to the powder chamber.

6. The powder container as claimed in claim 5, wherein, when the container cover has been placed into or onto the opening formed in the upper top wall of the powder container, the at least one powder feed inlet is arranged above the screen insert in such a way that powder fed by way of the at least one powder feed inlet falls onto a screen area of the screen insert.

7. The powder container as claimed in claim 1, the screen insert being dimensioned and the at least one powder feed inlet being arranged with regard to the screen insert in such a way that powder fed by way of the at least one powder feed inlet does not fall onto a screen area of the screen insert, when the container cover has been placed into or onto the opening formed in the upper top wall of the powder container.

8. A powder supplying device for a powder coating installation with at least one powder container as claimed in claim 1.

9. The powder supplying device as claimed in claim 8, the at least one powder container having a compressed air supply for introducing fluidizing compressed air into the powder chamber, and the at least one powder container having at least one outlet, leading out of the powder chamber, for discharging fluidizing compressed air introduced into the powder chamber.

10. The powder supplying device as claimed in claim 8, the at least one powder feed inlet being connected or connectable to a powder supply line.

11. The powder supplying device as claimed in claim 10, the screen insert being dimensioned and the at least one powder feed inlet being arranged with regard to the screen insert in such a way that the powder fed by way of the at least one powder feed falls onto a screen area of the screen insert.

12. The powder supplying device of claim 8, the screen insert being dimensioned and the at least one powder feeding inlet being arranged with regard to the screen insert in such as way that powder fed by way of the at least one powder feed inlet does not fall onto a screen area of the screen insert, when the container cover has been placed into or onto the opening formed in the upper top wall of the powder container.

13. The powder container as claimed in claim 1, wherein the container cover is a monolithic component.

14. The powder container as claimed in claim 1, wherein the container cover has a portion that has a length, a width, and a height, wherein the length and width are both greater than the height.

15. The powder container as claimed in claim 1, wherein the container cover has first major portion that has a first length, a first width, and a first height, wherein the first length and first width are both greater than the first height, and wherein the screen insert has a second major portion that has a second length, a second width, and a second height, wherein the second length and second width are both greater than the second height, and wherein the first major portion and the second major portion extend in the respective length and width directions parallel to one another.

16. The powder container as claimed in claim 1, wherein all of the container cover is completely located on one side of a face of the screen insert, and the screen insert is completely supported by the container cover.

17. The powder container as claimed in claim 1, wherein the screen insert has a length, a width, and a height, wherein the length are width are both greater than the height, and wherein the screen insert has a face that is parallel to the length and width directions, and wherein all of the container cover is completely located on one side of the face, wherein the face is on an opposite side of the screen insert from the ultrasonic transducer.

18. The powder container as claimed in claim 1, wherein the ultrasonic transducer is located such that at least a portion thereof is located on one side of the container cover that is opposite from the screen insert.

19. The powder container as claimed in claim 1, wherein the screen insert is connected to the container cover by the ultrasonic transducer.

20. The powder container as claimed in claim 19, the screen insert being connected to the ultrasonic transducer by way of an angle connection.

* * * * *